US007959432B2

(12) United States Patent
Steur, Jr.

(10) Patent No.: US 7,959,432 B2
(45) Date of Patent: Jun. 14, 2011

(54) METHOD OF AND APPARATUS FOR CLEANING FOULING IN HEAT EXCHANGERS, WASTE-HEAT BOILERS AND COMBUSTION CHAMBERS

(75) Inventor: Frans Steur, Jr., Apeldoorn (NL)

(73) Assignee: Frans Steur, Senior, Sittensen (DE)

( * ) Notice: Subject to any disclaimer, the term of this patent is extended or adjusted under 35 U.S.C. 154(b) by 916 days.

(21) Appl. No.: 11/142,565

(22) Filed: Jun. 1, 2005

(65) Prior Publication Data

US 2006/0272684 A1 Dec. 7, 2006

(51) Int. Cl.
*F42D 3/00* (2006.01)
*F42D 99/00* (2009.01)

(52) U.S. Cl. ..... 431/122; 431/3; 431/32; 431/121; 122/379; 102/323; 165/5; 165/95; 165/303

(58) Field of Classification Search ..... 102/323; 122/379; 165/5, 95, 303; 126/303; 431/3, 431/32, 121
See application file for complete search history.

(56) References Cited

U.S. PATENT DOCUMENTS

| | | | | | |
|---|---|---|---|---|---|
| 2,587,694 | A | * | 3/1952 | Chalmers et al. | 102/275.4 |
| 2,839,435 | A | | 6/1958 | Boswell | |
| 3,212,439 | A | * | 10/1965 | Reyne | 102/202.14 |
| 3,244,103 | A | * | 4/1966 | Spickard | 102/202.5 |
| 3,245,485 | A | * | 4/1966 | Bell | 175/4.6 |
| 3,495,455 | A | * | 2/1970 | Allgood | 73/147 |
| 3,590,739 | A | * | 7/1971 | Persson | 102/275.5 |
| 3,837,279 | A | * | 9/1974 | Cooke, Jr. | 102/317 |
| 3,939,941 | A | * | 2/1976 | Steele | 181/116 |
| 4,024,817 | A | * | 5/1977 | Calder et al. | 102/275.8 |
| 4,052,939 | A | * | 10/1977 | Simmons et al. | 102/323 |
| 4,085,676 | A | * | 4/1978 | Calder et al. | 102/332 |
| 4,282,812 | A | * | 8/1981 | Forgey et al. | 102/318 |
| 4,645,542 | A | * | 2/1987 | Scharton et al. | 134/1 |
| 4,655,846 | A | * | 4/1987 | Scharton et al. | 134/1 |
| 4,656,948 | A | * | 4/1987 | Tsukiuda et al. | 102/452 |
| 4,827,953 | A | * | 5/1989 | Lee | 134/172 |
| 4,872,408 | A | * | 10/1989 | Marz | 102/324 |
| 4,898,066 | A | * | 2/1990 | Marz | 86/20.1 |
| RE33,202 | E | * | 4/1990 | Janoski | 102/202.3 |
| 5,056,587 | A | * | 10/1991 | Jones et al. | 165/84 |
| 5,082,502 | A | * | 1/1992 | Lee et al. | 134/1 |

(Continued)

FOREIGN PATENT DOCUMENTS

AT PS 111 640 12/1928

(Continued)

OTHER PUBLICATIONS

Handbach Sprengtechnik, Hellmut Heinze, VEB Deutscher Verlag fur Grundstoffindustrie, Leipzig 1980, pp. 344-351.

(Continued)

*Primary Examiner* — Kenneth B Rinehart
*Assistant Examiner* — Jorge Pereiro
(74) *Attorney, Agent, or Firm* — TraskBritt

(57) ABSTRACT

A device for cleaning contamination in heat exchangers, waste-heat boilers, or combustion chambers is provided. In some embodiments, the device comprises a tube, a blasting body, and a combustible gas mixture within the tube. In some embodiments, the tube is destroyed after blasting. In some embodiments, the device further comprises a second tube comprising a blasting cord that is connected to a fuse, wherein the second tube is coupled to the first tube by a hinge.

6 Claims, 3 Drawing Sheets

U.S. PATENT DOCUMENTS

| | | | | |
|---|---|---|---|---|
| 5,092,355 | A * | 3/1992 | Cadwell et al. | 134/1 |
| 5,194,217 | A * | 3/1993 | St. Louis et al. | 376/316 |
| 5,211,135 | A * | 5/1993 | Correia et al. | 122/379 |
| 5,307,743 | A * | 5/1994 | Jones | 102/307 |
| 5,307,866 | A * | 5/1994 | Weigel | 165/95 |
| 5,341,406 | A * | 8/1994 | Jens et al. | 376/316 |
| 5,430,691 | A * | 7/1995 | Fridman | 367/145 |
| 5,494,004 | A * | 2/1996 | Hunter, Jr. | 122/395 |
| 5,769,034 | A * | 6/1998 | Zilka et al. | 122/379 |
| 6,431,073 | B1 * | 8/2002 | Zilka et al. | 102/302 |
| 6,604,468 | B2 * | 8/2003 | Zilka et al. | 102/302 |
| 6,630,032 | B2 * | 10/2003 | Carmi et al. | 134/1 |
| 6,644,201 | B2 * | 11/2003 | Zilka et al. | 102/302 |
| 6,694,886 | B1 * | 2/2004 | Woodall et al. | 102/275.1 |
| 6,755,156 | B1 * | 6/2004 | Zilka et al. | 122/379 |
| 2004/0060735 | A1 * | 4/2004 | Beckman | 175/4.6 |
| 2005/0109231 | A1 * | 5/2005 | Bussing | 102/302 |

FOREIGN PATENT DOCUMENTS

| | | | |
|---|---|---|---|
| AU | 20 822/70 | | 4/1972 |
| DE | 3106421 | A1 * | 11/1982 |
| DE | 198 52 217 | | 3/2000 |
| EP | 0 109 351 | | 3/1984 |
| EP | 1 067 349 | | 1/2001 |
| EP | 1 226 881 | | 7/2002 |
| GB | 823 353 | | 11/1959 |
| GB | 2061148 | A * | 5/1981 |
| GB | 2192039 | A * | 12/1987 |
| JP | 04-155200 | | 5/1995 |
| LU | 41 977 | | 8/1962 |
| RU | 576704 | A1 * | 6/1996 |

OTHER PUBLICATIONS

Handbook der Technischen Termperaturemessung, Fritz Lieneweg, Vieweg Verlag, 1976, pp. 273-276.

"Use of explosives for boiler deslagging gains acceptance", R. Swanekamp, Power, McGraw Hill, Special Report Nuclear Power, Mar. 1996, pp. 49-51.

Declaration of William R. Harvey, dated Sep. 17, 2004.

Library Order Form re: "Use of explosives for boiler deslagging gains acceptance", R. Swanekamp, Power, McGraw Hill, Special Report Nuclear Power, Mar. 1996.

Energy Citation Database re: "Use of explosives for boiler deslagging gains acceptance", R. Swanekamp, Power, McGraw Hill, Special Report Nuclear Power, Mar. 1996.

Cat.Inist (Institute de l'Information Scientifique et Technique) re: "Use of explosives for boiler deslagging gains acceptance", R. Swanekamp, Power, Special Report Nuclear Power.

* cited by examiner

METHOD OF AND APPARATUS FOR CLEANING FOULING IN HEAT EXCHANGERS, WASTE-HEAT BOILERS AND COMBUSTION CHAMBERS

It is generally known that heat exchangers, waste-heat boilers, and combustion chambers (i.e., spaces in which combustion takes place which are provided with lines through which flows a medium to be heated) have to be cleaned at certain time intervals. The reason such cleaning becomes necessary is that the lines through which flows a medium to be heated gather soot on their outsides due to the combustion process within the combustion chamber, or else become covered by a layer of combustion residues that impede or prevent the transfer of heat. The gathering of soot and/or combustion residues ultimately reduces the level of efficiency of the heat exchanger, waste heat boiler, or combustion chamber.

"Explosion cleaning procedures" are implemented for cleaning such spaces and lines. For example, a textile bag is filled with a gas mixture outside the space to be cleaned, introduced into the space which is to be cleaned, and caused to explode therein. Such a method may involve an explosive effect emanating from a ball-shaped textile bag. However, since the lines which carry the medium to be heated are often very close together, the blasting effect can detach only a small part of the pollutants and contaminating material which are applied externally to the lines or inside walls of the space to be cleaned, but frequently not any of the contaminating material and pollutants which are disposed between the tubes or, as viewed from the explosion point, behind the tubes.

Disclosed herein is a device for cleaning contamination in a heat exchanger apparatus, a heat boiler apparatus, or combustion chamber. In some embodiments, the device permits cleaning of contamination in a space to be cleaned that is below room temperature, or below 100° C. In some embodiments, the device allows the detachment of more than a small part of pollutants and contaminating material which are applied externally to the lines or inside walls of the space to be cleaned, and/or some of any contaminating material and pollutants which are disposed between the tubes or, as viewed from the explosion point, behind the tubes. In some embodiments, the device comprises a long tube with a relatively small diameter wherein a combustible gas mixture and/or a blasting body is provided within the tube, and the tube is destroyed after blasting. In some embodiments, the device comprises a first tube and a second tube, wherein the second tube is connected to the first tube by a hinge, and wherein the second tube contains a fuse connected to blasting cord.

The device is capable of effecting a linear blasting process (as opposed to a ball-shaped blasting process), wherein the blasting effect is distributed over a great length. Thus, in some embodiments, a tube (e.g., a tube of cardboard and/or copper) may be filled with a gas mixture, and/or provided with a blasting cord on the inside of the tube, so that a desired blasting effect can be achieved by the blasting process. An explosion in accordance with the invention may generate a shock wave that removes polluting contamination from a heat exchanger. In some embodiments, a small tube diameter allows cleaning between contaminated lines or bundles of lines. And, if a coolant is flowing through the blasting tube, the cleaning operation may take place when the temperature within the combustion chamber of the heat exchanger has not yet fallen very far (for example, during operation of the heat exchanger, or after the heat exchanger has been shut down for a short time). Thus, in some embodiments, long periods during which the heat exchanger must be shut down for cleaning (for example, periods up to several days) may be avoided.

The foregoing and other features will become more apparent from the accompanying figures.

FIG. 1 shows a cardboard tube 1, which accommodates a spark plug 2. The tube is provided at one end with a closure means, and a gas filling connection 5 is provided at the other end.

FIG. 2 shows an assembled embodiment 6 of the device.

Depending on the desired use, the tube can be made of any length. For example, in the embodiment depicted in FIG. 2, the tube is of a relatively small diameter (e.g., 3 cm to 15 cm), so that the tube may be introduced into a heat exchanger line containing gases within a combustion chamber.

After triggering of a blasting action which may destroy the entire cardboard tube, certain parts, such as a spark plug, threaded rod, closure means, and so forth, can be further used again.

When one of several embodiments of the described device is introduced into a combustion chamber (i.e., between tube bundles 8 and 9), cleaning of tube bundles 8 and 9 may be effected by means of triggering an explosion. To provide so that the blasting does not take place at an unwanted moment in time, the tube interior may be suitably cooled by means of a supply of water or air, which is introduced through first tube 1.

A blasting cord (and possibly an explosive gas mixture) may be provided within second tube 2, and the blasting cord may be connected to a fuse. As further shown in FIG. 4, the first tube (and possibly the second tube) may contain a flowing coolant stream (for example, an air/water mixture). A fuse may be connected via a fuse line to a triggering device of the firing mechanism outside the tube. Coolant may flow into the first tube and the second tube, so that the fuse and the blasting cord are sufficiently cooled such that an unforeseen explosion is not prematurely triggered. The presence of a hinge may facilitate the flow of coolant into the second tube.

When the blasting process is triggered, the outer tube may be shattered (for example, if the outer tube is made of cardboard, glass, metal, copper, or plastic material), and individual particles produced by the blasting process may strike and detach contaminating material on tubes to be cleaned within the combustion chamber.

Figure 5:
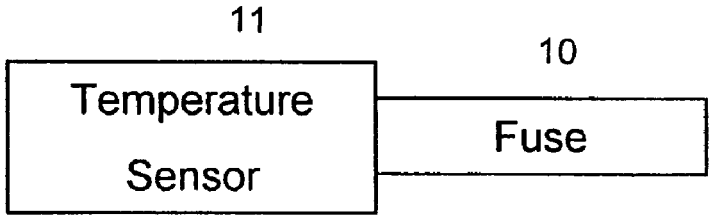

As depicted in FIG. 5, a fuse 10 may be provided with a temperature sensor 11, such that an amount of coolant flowing in the first and/or second tube may be adjusted such that unforeseen blasting is not prematurely caused.

Figure 1:
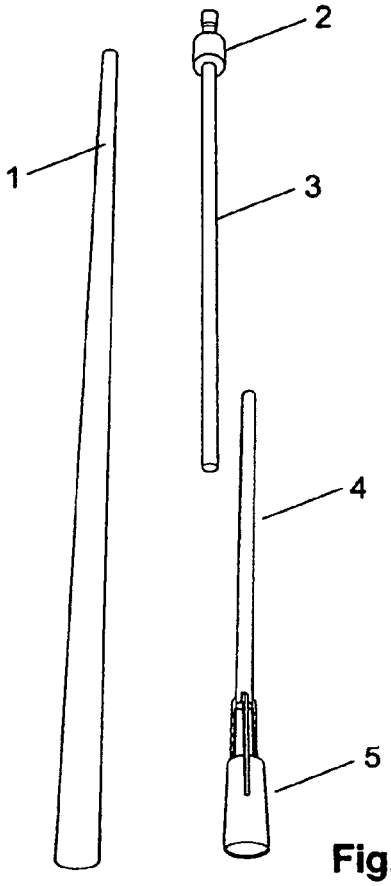
Figure 2:
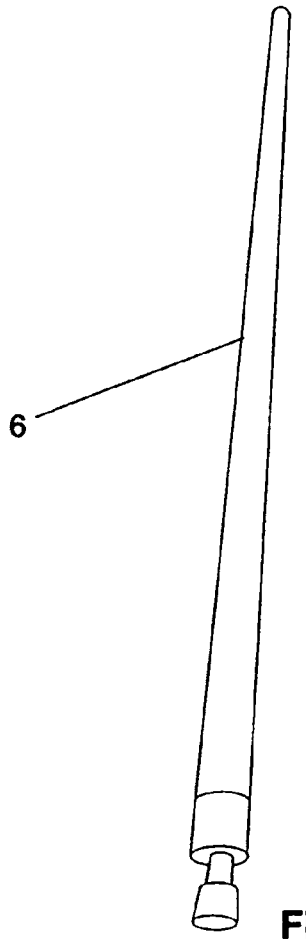
Figure 3:
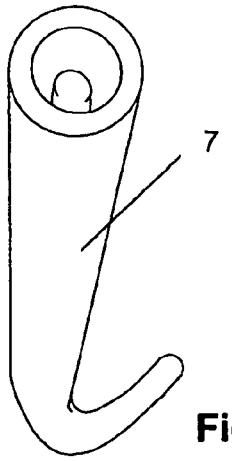
FIG. 3 shows an alternative embodiment, wherein a first tube, which is connected to a second tube via a hinge 7, is fitted into a combustion chamber. Due to the hinge 7, the angle of the second tube (blasting tube) can be precisely adjusted according to the discretion of the user.
Figure 4:
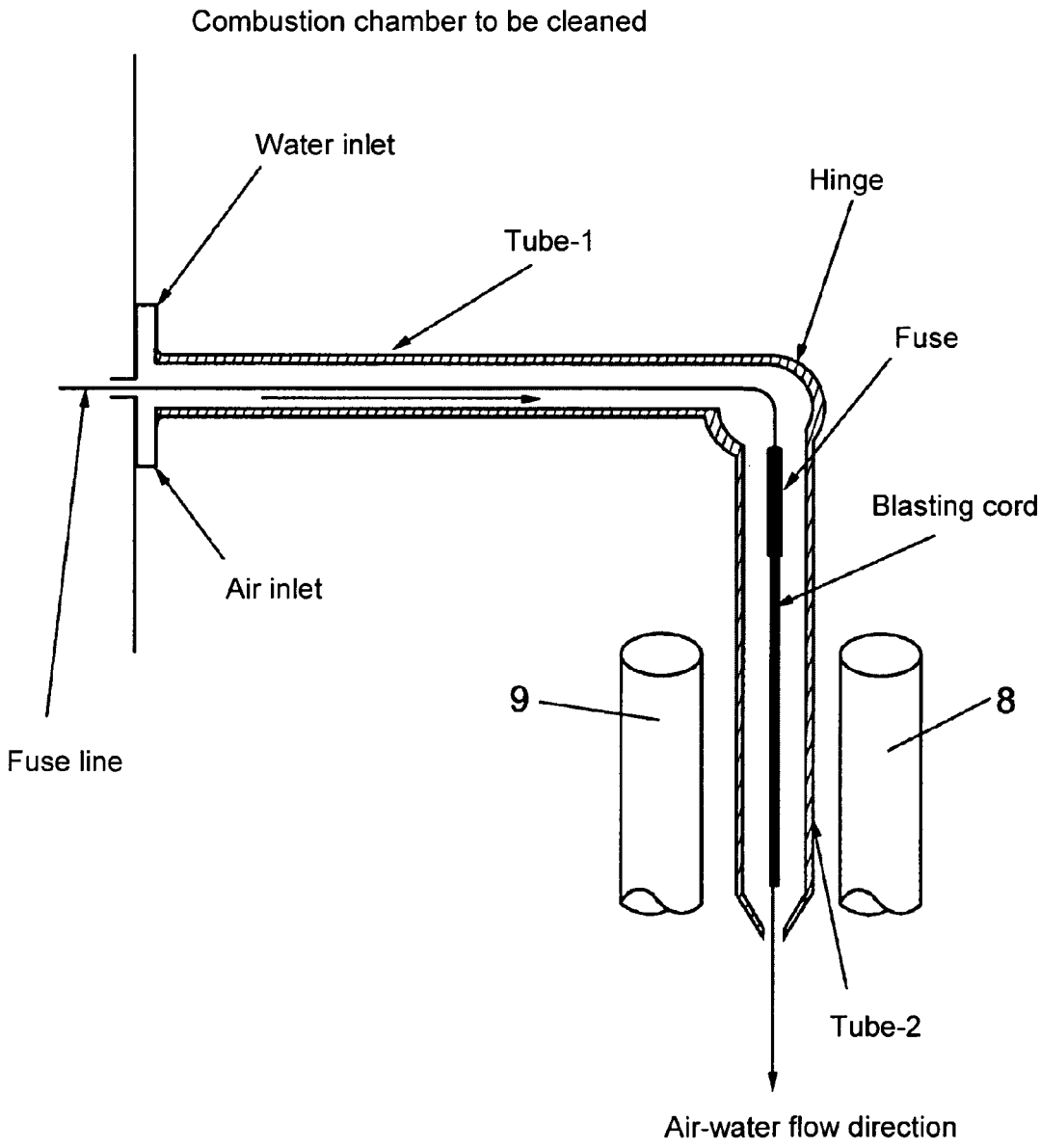
FIG. 4 shows a view of an embodiment wherein a first tube 1 is connected via a hinge to a second tube 2. Arranged within the second tube is a fuse which is connected to a blasting cord.

As depicted in FIG. 4, blasting tubes may be of such dimensions that the blasting tubes fit between lines to be cleaned within the combustion chamber. Thus, contaminating material between or behind the lines to be cleaned within the combustion chamber may be detached therefrom.

What is claimed is:

1. A device for cleaning contamination in a heat exchanger, a heat boiler, or a combustion chamber, the device comprising:

a first tube;

a hinge coupled to the first tube;

a second tube including a coolant disposed therein, wherein the second tube is coupled to the first tube via the hinge;

a blasting body disposed in the second tube;

a fuse, to responsively initiate blasting, disposed in the second tube and coupled to the blasting body;

a fuse line connected to the fuse; and a temperature sensor to measure a temperature, wherein the temperature sensor is disposed in proximity to the fuse and wherein an amount of the coolant is adjusted in response to the measured temperature, wherein the second tube shatters upon blasting, providing particles thereof to strike and detach contamination in the heat exchanger apparatus, heat boiler apparatus, or combustion chamber apparatus.

2. The device according to claim 1, wherein the coolant is an air/water mixture.

3. The device of claim 1 wherein the second tube consists essentially of metal material.

4. The device of claim 1 wherein the second tube is comprised of a material comprising a cardboard, a glass, a metal or a plastic.

5. A method for cleaning contamination in a heat exchanger apparatus, heat boiler apparatus, or combustion chambers apparatus, using the device of claim 1, the method comprising terminating the operation of the heating assembly of the heat exchanger apparatus, heat boiler apparatus, or combustion chambers apparatus; and triggering the device of claim 4 when the temperature in the interior of the assembly is greater than 300° C., wherein, in response thereto, the second tube shatters providing particles thereof to strike and detach contamination in the heat exchanger apparatus, heat boiler apparatus, or combustion chamber apparatus.

6. The method of claim 5 wherein triggering the device of claim 1 when the temperature in the interior of the assembly is greater than 700° C., wherein, in response thereto, the second tube shatters providing particles thereof to strike and detach contamination in the heat exchanger apparatus, heat boiler apparatus, or combustion chamber apparatus.

* * * * *

UNITED STATES PATENT AND TRADEMARK OFFICE

CERTIFICATE OF CORRECTION

PATENT NO. : 7,959,432 B2
APPLICATION NO. : 11/142565
DATED : June 14, 2011
INVENTOR(S) : Frans Steur, Jr.

It is certified that error appears in the above-identified patent and that said Letters Patent is hereby corrected as shown below:

| | | | |
|---|---|---|---|
| | COLUMN 1, | LINE 48, | change “to blasting” to --to a blasting-- |
| | COLUMN 2, | LINE 7, | change “embodiment 6” to --embodiment **6**-- |
| CLAIM 5, | COLUMN 4, | LINE 3, | change “chambers” to --chamber-- |
| CLAIM 5, | COLUMN 4, | LINE 4, | change “comprising” to --comprising:-- |
| CLAIM 5, | COLUMN 4, | LINE 7, | change “chambers” to --chamber-- |
| CLAIM 5, | COLUMN 4, | LINE 8, | change “claim **4**” to --claim **1**-- |

Signed and Sealed this
Twenty-fourth Day of January, 2012

David J. Kappos

David J. Kappos
*Director of the United States Patent and Trademark Office*